US011975874B2

(12) United States Patent
Kloeppel et al.

(10) Patent No.: US 11,975,874 B2
(45) Date of Patent: May 7, 2024

(54) VACUUM SEALER WITH SEALING BAG COOLING ENHANCEMENT AND IMPROVED LIFT MECHANISM

(71) Applicant: Blue Sky Innovation Group, Inc., Sheffield Village, OH (US)

(72) Inventors: Gregg Kloeppel, Sheffield Lake, OH (US); Jeffrey W. Palese, Grafton, OH (US)

(73) Assignee: BLUE SKY INNOVATION GROUP, INC., Grafton, OH (US)

( * ) Notice: Subject to any disclaimer, the term of this patent is extended or adjusted under 35 U.S.C. 154(b) by 54 days.

(21) Appl. No.: 17/000,437

(22) Filed: Aug. 24, 2020

(65) Prior Publication Data

US 2021/0053711 A1 Feb. 25, 2021

Related U.S. Application Data

(60) Provisional application No. 62/890,640, filed on Aug. 23, 2019.

(51) Int. Cl.

| | |
|---|---|
| ***B65B 31/02*** | (2006.01) |
| ***B65B 31/06*** | (2006.01) |
| ***B65B 51/10*** | (2006.01) |
| ***B65B 51/32*** | (2006.01) |

(52) U.S. Cl.

CPC ..... *B65B 31/06* (2013.01); *B65B 51/10* (2013.01); *B65B 51/32* (2013.01)

(58) Field of Classification Search

CPC ..... B65B 31/02
USPC ..... 53/510
See application file for complete search history.

(56) References Cited

U.S. PATENT DOCUMENTS

| | | | | |
|---|---|---|---|---|
| 6,256,968 | B1 * | 7/2001 | Kristen | F04B 49/022 53/512 |
| 6,276,419 | B1 * | 8/2001 | Maruyama | B29C 66/8227 156/583.8 |
| 8,635,836 | B2 * | 1/2014 | Tan | B31D 5/0073 53/433 |
| 9,708,088 | B2 * | 7/2017 | Rausch | B65B 51/148 |
| 2003/0213216 | A1 * | 11/2003 | Harte | B29C 65/222 53/374.9 |

(Continued)

*Primary Examiner* — Thanh K Truong
*Assistant Examiner* — Patrick B Fry
(74) *Attorney, Agent, or Firm* — TAROLLI, SUNDHEIM, COVELL & TUMMINO L.L.P.

(57) ABSTRACT

A vacuum sealer for vacuum packing products in plastic vacuum bags includes a sealing bar and a lift mechanism configured to raise and lower the sealing bar. In the raised position, the sealing bar is configured to engage and compress the vacuum bag against a compression bar. The vacuum sealer include a vacuum pump that is operated to draw a vacuum in the vacuum bag. The sealing bar includes a heating element that is configured to heat the sealing bar when energized. Once the vacuum is drawn in the vacuum bag, the sealing bar is heated and the heat is applied to the vacuum bag, which seals closed the vacuum bag with the product vacuum packed therein. The lifting mechanism lowers the sealing bar to release the vacuum packed product. The vacuum sealer includes a cooling chamber into which the sealing bar is moved when lowered by the lift mechanism. A cooling fan directs convection air through the cooling chamber and over the sealing bar to cool the sealing bar.

8 Claims, 7 Drawing Sheets

(56) References Cited

U.S. PATENT DOCUMENTS

| | | | | |
|---|---|---|---|---|
| 2009/0100804 | A1* | 4/2009 | Bonneville | B65B 41/14 53/559 |
| 2018/0177323 | A1* | 6/2018 | Lee | A47J 27/18 |
| 2018/0264730 | A1* | 9/2018 | McMahon | B08B 3/00 |

* cited by examiner

VACUUM SEALER WITH SEALING BAG COOLING ENHANCEMENT AND IMPROVED LIFT MECHANISM

RELATED APPLICATIONS

This application claims the benefit of U.S. Provisional Application Ser. No. 62/890,640, which was filed on Aug. 23, 2019. The subject matter of this application is hereby incorporated by reference in its entirety.

BACKGROUND

Vacuum sealers are used extensively to preserve foods, such as meats and produce, in vacuum sealed plastic bags. To achieve this, the food product is placed in the plastic vacuum bag, and the open end of the bag is placed in a vacuum chamber of the sealer. The vacuum sealer is then operated to draw a vacuum in the bag by removing air from the bag with a pump. Once the vacuum is drawn, a heated sealing bar clamps down on the open end of the vacuum bag, which melts and fuses together the plastic bag material, sealing the bag closed. As a result, the food is vacuum sealed or vacuum packed, inside the bag.

Preserving large batches of food in this manner requires a large number of bags to be vacuum sealed during the same batch operation. Continuously operating the vacuum sealer in these batch operations can cause excessive use of the sealing bar, causing it to overheat. This can cause damage to the vacuum sealer or, for a vacuum sealer with built-in fault circuitry, can result in a fault condition that causes the vacuum sealer to enter a shut-down mode, which allows the sealing bar to cool before resuming operation. These shut-downs can last up to 20 minutes or longer. Therefore, when this occurs, the batch operation is paused, which wastes time and reduces the efficiency of the batch operation.

When placing the open end of the vacuum bag in the vacuum chamber, it is important to achieve proper bag alignment. If the bag is not positioned properly, e.g., over-inserted, under-inserted, inserted diagonally, etc., the result can be that a seal is not formed across the entire bag opening. As a result, the vacuum will not be maintained and re-packaging the food product, re-forming the vacuum, and re-sealing the bag is required, wasting more time. Additionally, if the vacuum sealer is not configured to provide the user with a good view of the vacuum chamber during vacuum formation and bag sealing, detecting improper bag positioning can be difficult or impossible. As a result, detecting an improper bag seal cannot occur until after the entire vacuum sealing cycle is completed and the bag is removed, which wastes even more time.

SUMMARY

An improved vacuum sealer provides features for cooling the sealing bar heater between vacuum bag sealing cycles. The vacuum sealer is configured to permit an operator to seal plastic vacuum bags continuously, without failure or shutting-down to cool before resuming the next sealing operation. To facilitate this functionality, the vacuum sealer implements a mechanical system, internal to the vacuum sealer, that raises and lowers the sealing bar heater vertically. In the raised position of the sealing bar, the bar heats and seals the plastic vacuum bag. In the lowered position of the sealing bar, the bar is positioned in a cooling chamber where cool air is circulated over the sealing bar, to cool the sealing bar prior to the next sealing operation, while the next vacuum bag is being positioned in the vacuum chamber. This cooling feature allows the vacuum sealer to operate continuously without the sealing bar over-heating. Advantageously, the vacuum sealer avoids faults or shutdowns due to over-heating, which allows for continuous vacuum sealing operation, even in large batch vacuum sealing operations.

Additionally, the vacuum sealer is configured to facilitate and promote proper alignment of the vacuum bag in the vacuum sealing chamber, which allows the operator to place the plastic bag in a fixed location repeatedly, reliably, and in succession, so that the vacuum formation and sealing is efficient and expedient. To further promote the efficiency and expedience with which the vacuum sealing function is performed, the vacuum sealer is also configured to provide an illumination feature that promotes visibility of the vacuum chamber during use so that the vacuum sealing operation can be observed visually to monitor progress and seal formation in real-time.

According to one aspect, a vacuum sealer for vacuum packaging a product in a plastic vacuum bag includes a vacuum chamber including a vacuum pump and a cooling chamber including a cooling fan. A compression bar is positioned above the cooling chamber. A sealing bar includes a heating element configured, when energized, to heat the sealing bar. A lift mechanism is actuatable to move the sealing bar to a lowered position in the cooling chamber and a raised position above the cooling chamber. The sealing bar is configured to compress the vacuum bag against a compression bar when in the raised position. The vacuum pump is configured to draw a vacuum in the vacuum bag while the vacuum bag is compressed between the sealing bar and the compression bar. The sealing bar is configured to heat and seal closed the vacuum bag with the vacuum formed therein. The cooling fan is configured to circulate convection air over the sealing bar to cool the sealing bar when in the lowered position.

According to another aspect, alone or in combination with other aspects, the vacuum sealer can also include comprising alignment posts, positioned in the vacuum chamber, for aligning the vacuum bag in the vacuum chamber.

According to another aspect, alone or in combination with other aspects, the vacuum sealer can also include a lid having an opened condition and a closed condition. The lid, when in the opened condition, can expose the vacuum chamber and allow for placement and removal of the vacuum bag therein. The lid can include a translucent window for viewing the vacuum chamber and the vacuum bag disposed therein when the lid is in the closed condition. The vacuum sealer can also include an illumination source that is actuatable to illuminate the vacuum chamber throughout a vacuum formation and sealing process performed by the vacuum sealer.

According to another aspect, alone or in combination with other aspects, the lift mechanism can include a solenoid for moving the sealing bar to the raised and lowered positions. The lift mechanism be configured to guide movement of the sealing bar between the raised and lowered positions into and out of the cooling chamber and to maintain proper alignment of the sealing bar with the compression bar.

According to another aspect, alone or in combination with other aspects, the lift mechanism can include a base supported in the cooling chamber and a top plate that supports the sealing bar. The base and top plate can be interconnected by a sliding engagement that enforces relative movement of the top plate relative to the base between the raised and lowered positions in response to actuation of the lift mechanism.

According to another aspect, alone or in combination with other aspects, the lift mechanism can include a mechanical slide mechanism including a base mounted pin and a top plate mounted bushing that receives the pin. The sliding engagement interconnecting the base and top plate can be a sliding engagement between the pin and bushing.

According to another aspect, alone or in combination with other aspects, the lift mechanism can include a scissor lift mechanism including a pair of scissor arms arranged in an X-shaped configuration. The scissor arms can have lower ends pivotally connected to opposite ends of the base, centers pivotally connected to each other, and upper ends slidably received in a channel of the top plate. The sliding engagement interconnecting the base and top plate can be a sliding engagement of the upper ends of the scissor arms in the channel.

DETAILED DESCRIPTION

Figure 1:
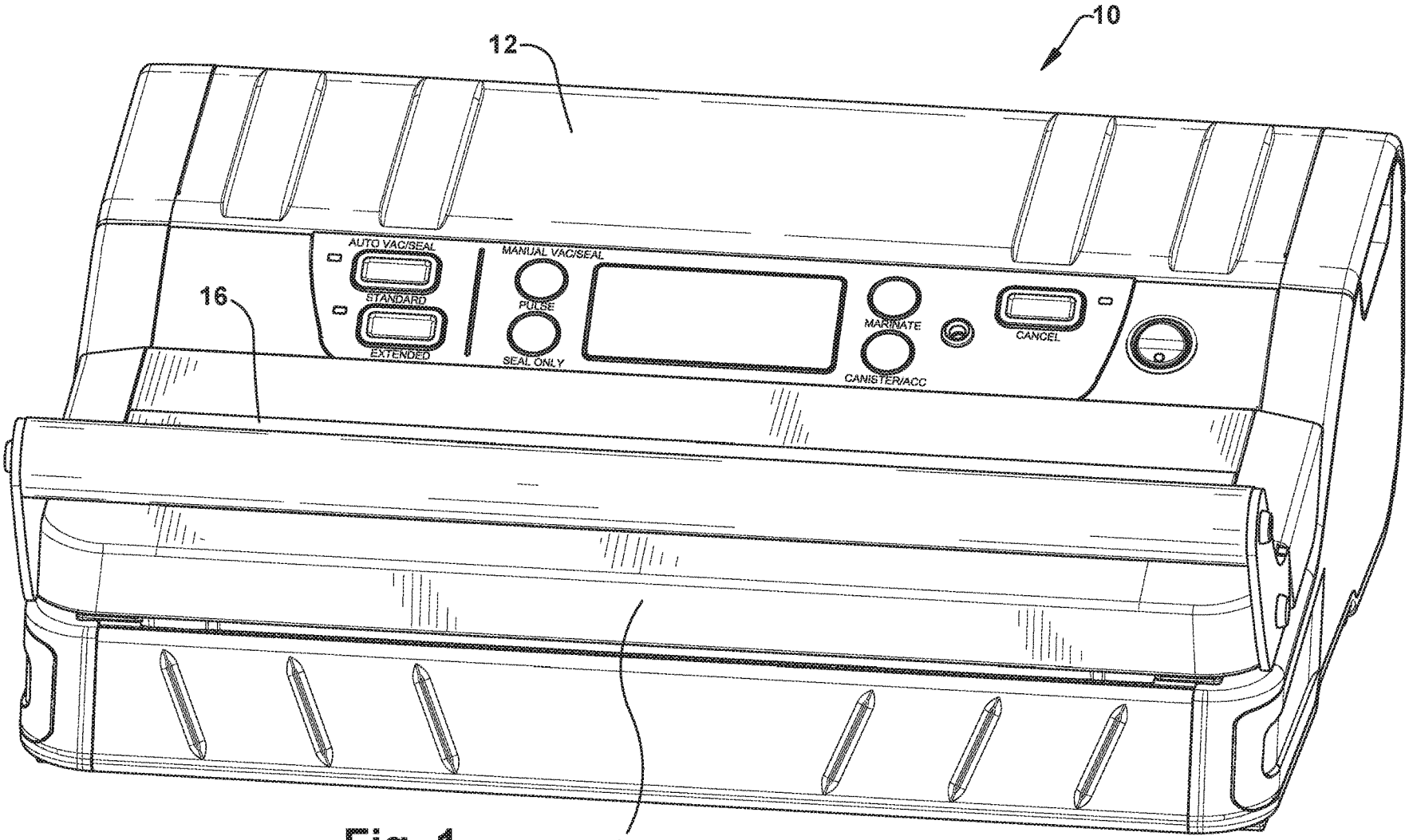
FIG. 1 is a perspective view of vacuum sealer, according to an example embodiment of the invention.

Referring to FIG. 1, according to an example embodiment, a vacuum sealer 10 is configured for vacuum sealing products, such as food products (e.g., meat, fish, poultry), in a plastic vacuum bag 120. The vacuum sealer 10 includes a housing 12, which encloses sealer components, such as a vacuum pump, sealing bar, lift mechanism, and electronic controls, which are described in further detail below. The housing 12 includes a lid 14, which can be lifted open manually in order to place an open end of the vacuum bag 120 in the vacuum sealer 10, and then closed to secure the vacuum bag therein.

Figure 2:
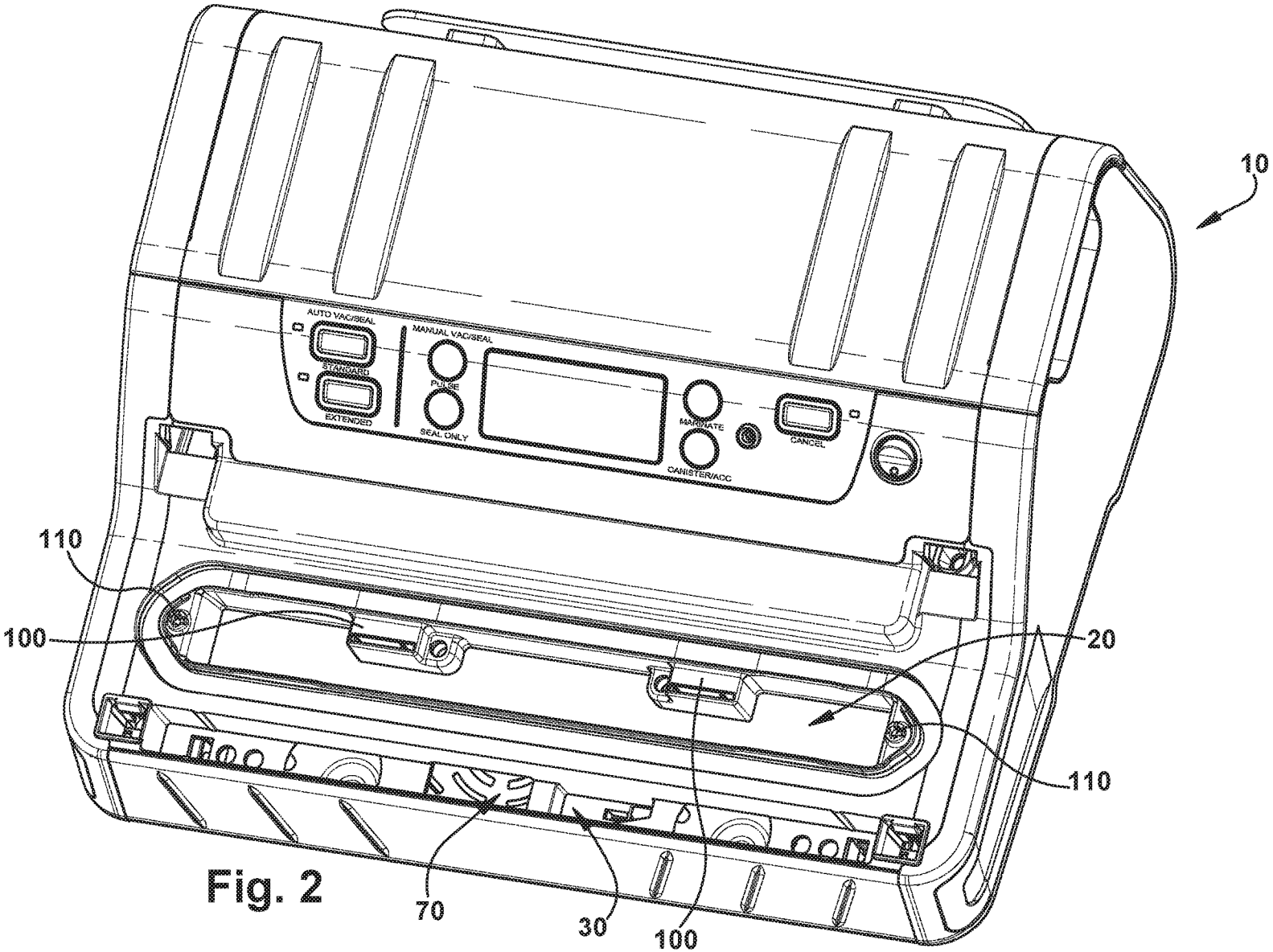
FIG. 2 is a perspective view of the vacuum sealer with certain portions removed to reveal cooling and vacuum chambers.

Referring to FIG. 2, the vacuum sealer 10 is shown with the lid 14 and other components removed, revealing certain main portions/components of the vacuum sealer: a vacuum chamber 20, a cooling chamber 30, a lift mechanism 70, alignment posts 100, and illumination source 110.

Figure 3:
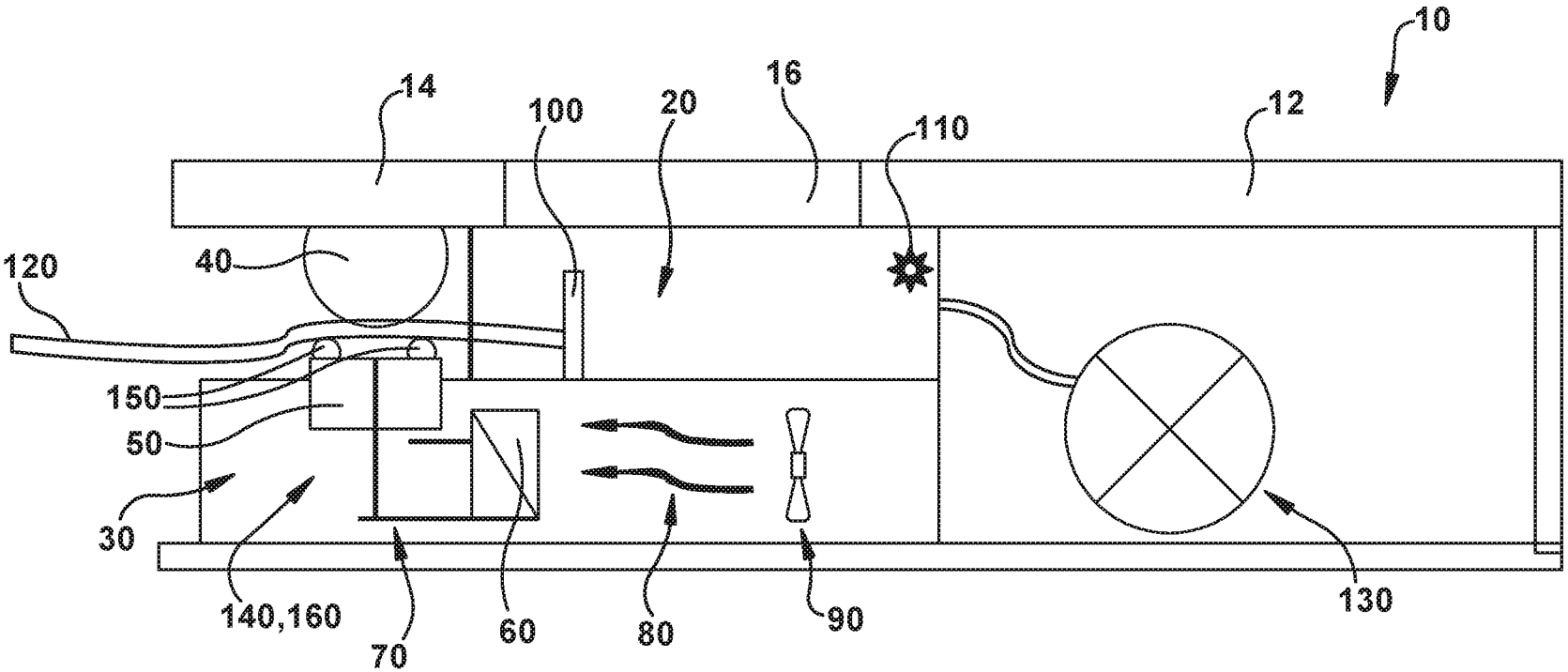
FIG. 3 is a schematic side view illustrating functional components of the vacuum sealer.

FIG. 3 is a schematic illustration representing the general arrangement of the main internal components of the vacuum sealer 10 in the housing 12, with the open end portion of the vacuum bag 120 secured therein. Referring to FIG. 3, the vacuum chamber 20 is operatively connected to a vacuum pump 130, which is operable to draw a vacuum in the vacuum chamber and also in the vacuum bag 120 when positioned therein. The vacuum chamber 20 includes the alignment pins 100 (two alignment pins in the example configuration, see FIG. 2) and the illumination source 110, which can, for example, be a pair of LEDs, one at each end of the vacuum chamber.

As viewed in FIG. 3, the cooling chamber 30 located below the vacuum chamber 20. The sealing bar 50 is supported in the cooling chamber 30 and is configured to be lifted vertically up and down by the lift mechanism 70. In the example configuration of FIG. 3, the lift mechanism 70 includes a slide lift mechanism 140 that is operable via an actuator 60, such as a solenoid, to raise and lower the sealing bar 50. With the open end of the plastic bag 120 aligned inside the vacuum chamber 20 by moving it into engagement with the alignment pins 100, the lift mechanism 70 is actuated to lift the sealing bar 50 to its upward position, as shown in FIG. 3.

In the upward position, the sealing bar 50 compresses the plastic bag 120 against a compression bar 40 supported on the lid 12 and seals closed the vacuum chamber 20. The vacuum pump 130 is operated to draw a vacuum in the vacuum chamber 20. Eventually, that vacuum overcomes the compression exerted on the plastic bag 120 by the sealing bar 50, air is evacuated from the vacuum bag 120, and a vacuum is drawn therein.

Once the vacuum is drawn, heating coils 150 on the sealing bar 50 are energized to apply heat to the vacuum bag 120. The heat melts the plastic material of the vacuum bag 120, causing it to fuse together and seal the bag opening while the vacuum is drawn. The sealing bar 50 can be actuated to the lowered position and the lid 14 can then be opened to release the vacuum bag 120 with the food product packaged therein from the vacuum sealer 10.

The lid 14 of the vacuum sealer 10 can include a translucent window 16 that allows the interior of the vacuum chamber 20 to be viewed during use. This viewing can be enhanced by the illumination source 110, which illuminates the vacuum chamber 20. The window 16 allows the end portion of the vacuum bag 120, resting against the alignment pins 100, to be viewed during the vacuum sealing process. Advantageously, this allows the user to observe whether the vacuum bag 120 maintains proper alignment in the vacuum chamber 20, and also to watch for the presence of liquids being removed from the bag.

Figure 4:
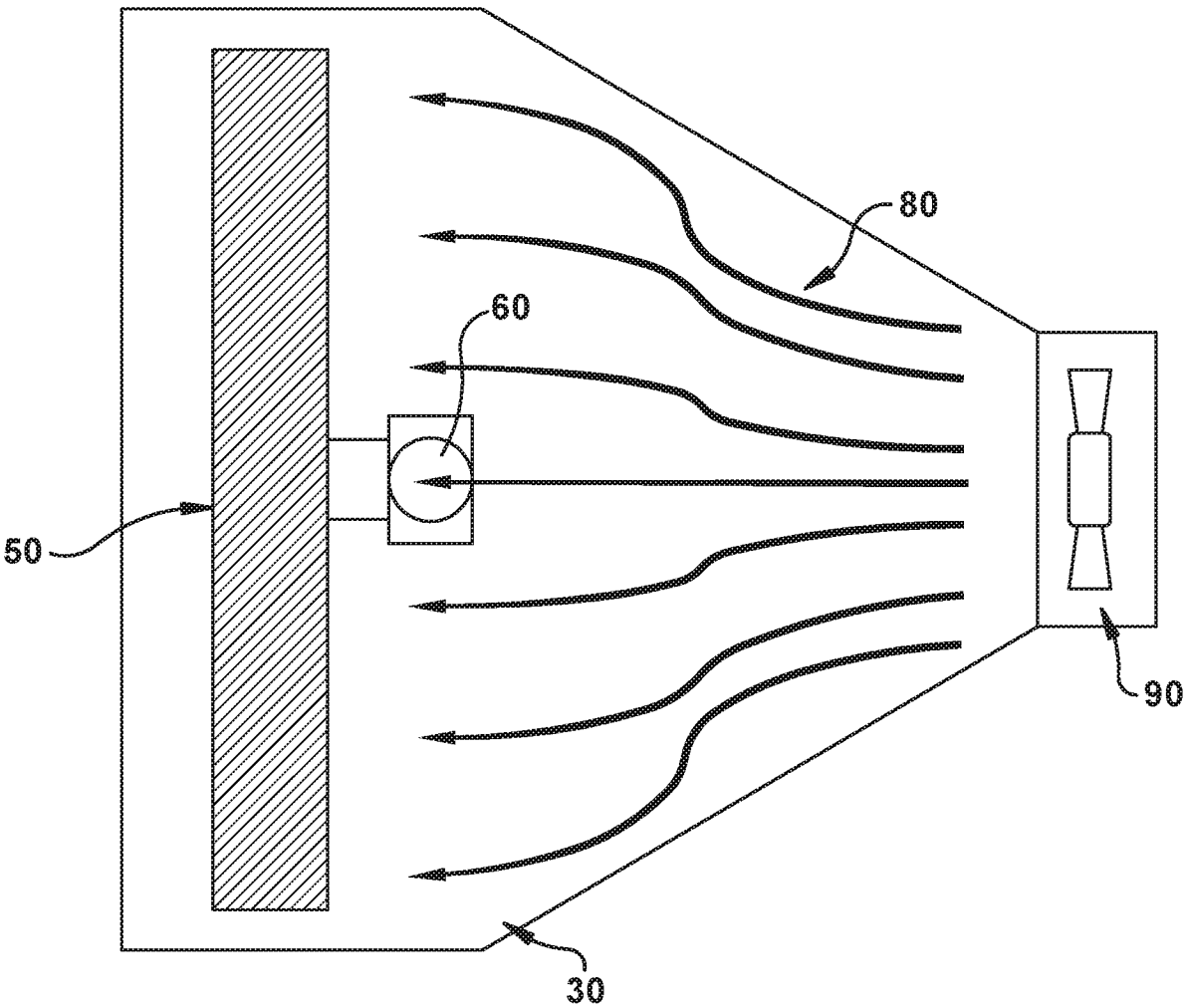
FIG. 4 is a schematic top view illustrating a sealing bar cooling function of the cooling chamber.

Referring to FIG. 4, when the sealing bar 50 is in its lowered position in the cooling chamber 30, the fan 90 is operated to circulate convection air 80 over the sealing bar 50 to cool the sealing bar and the heating coils 150. This cooling prevents the sealing bar 50 and heating coils 150 from becoming so heated during repeated use, e.g., due to large batch operation, that the sealing bar and coils heat and seal the vacuum bag 120 immediately when raised to the upper position, without the heating coils 150 being energized and before the vacuum is drawn. Cooling the sealing bar 50 and heating coils 150 when in the lowered position between vacuum sealing cycles therefore allows for continued use of the vacuum sealer 10 while avoiding the occurrence of the aforementioned premature bag sealing.

Figure 5B:
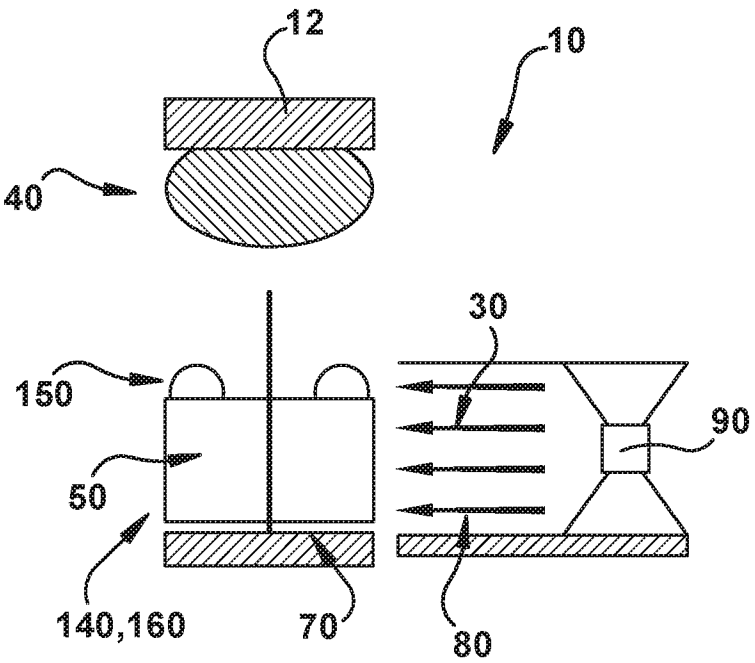
FIG. 5B is a schematic side view illustrating the sealing bar in a lowered cooling position.
Figure 5A:
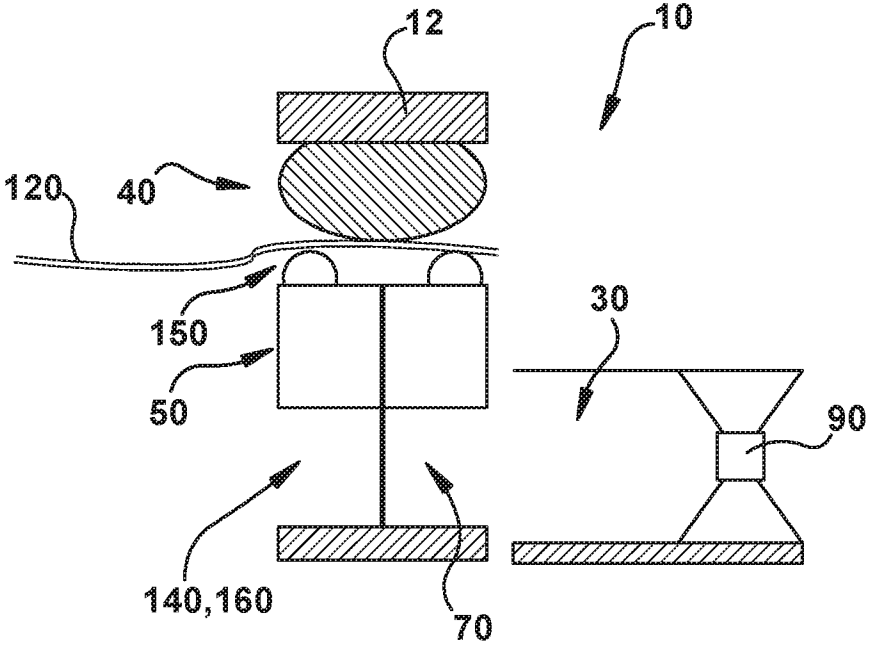
FIG. 5A is a schematic side view illustrating the sealing bar in a raised sealing position.

FIGS. 5A and 5B illustrate the raised and lowered positions, respectively, of the sealing bar 50. Referring to FIG. 5A, when the sealing bar 50 is moved to the raised position by the lift mechanism 70, it compresses the vacuum bag 120 against the compression bar 40, which allows the vacuum to be drawn in the vacuum bag and also allows the heating coils 150 to heat and seal the open end of the bag.

Referring to FIG. 5B, when the sealing bar 50 is moved to the lowered position by the lift mechanism 70, the sealed bag is released for removal from the vacuum sealer 10, to be replaced with the next vacuum bag to be sealed. At the same time, the sealing bar 50 is positioned in the cooling chamber 30 while in the lowered position. The cooling fan 90 is operated to circulate convection air 80 over the sealing bar 50 and the heating coils 150 to cool the bar and coils. This way, when the lift mechanism 70 is actuated to place the sealing bar 50 in the raised position compressing the next vacuum bag 120 in the batch, it does not seal the bag prematurely. Instead, sealing only occurs when the heating elements 150 are energized.

Figure 6:
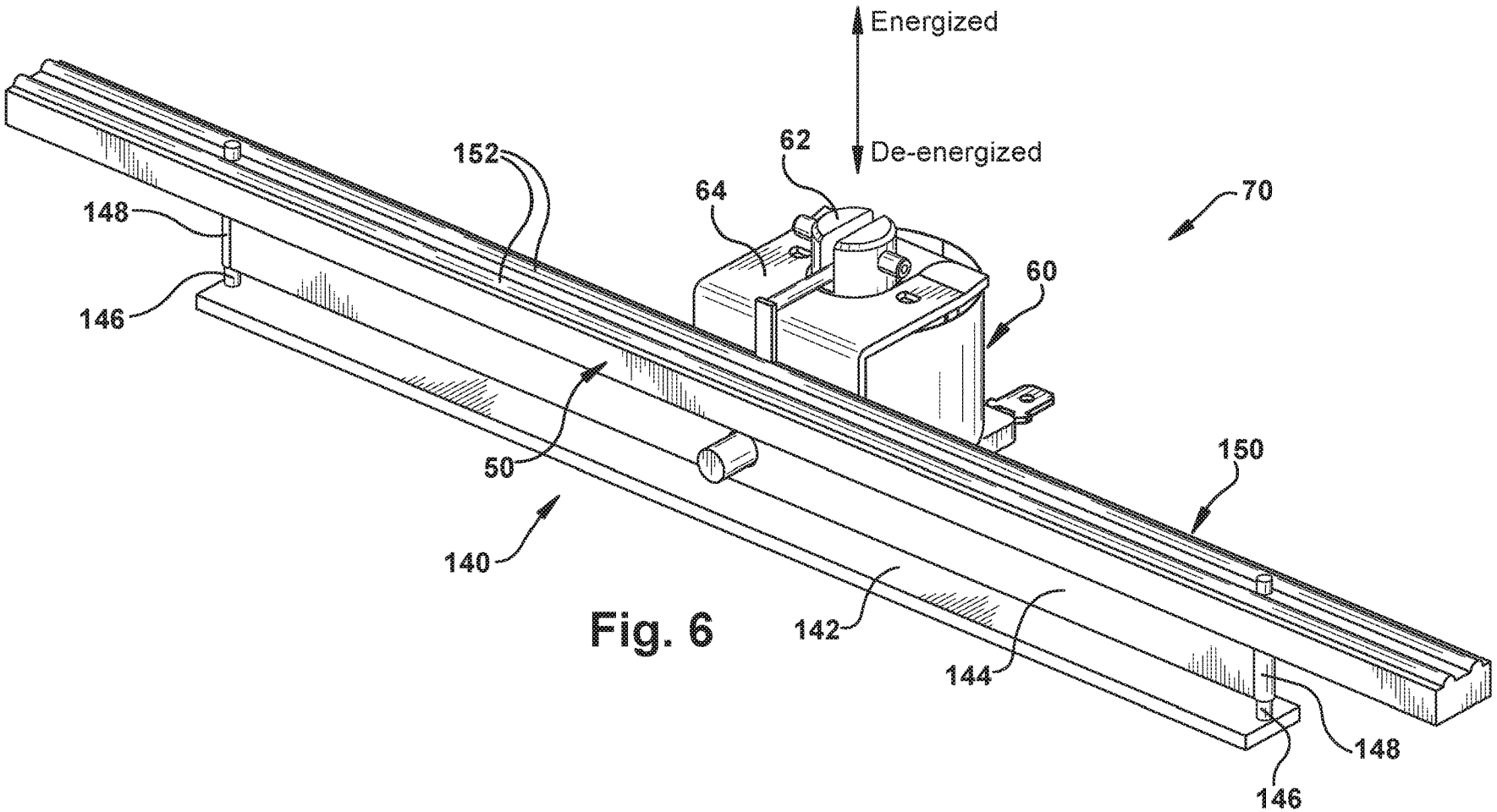
FIG. 6 is a perspective view of a mechanical slide lift mechanism for raising and lowering the sealing bar.

FIG. 6 illustrates an example configuration of the lift mechanism 70 in greater detail. As shown in FIG. 6, the actuator 60 is a solenoid that includes a plunger 62 connected to a bracket 64 to which the sealing bar 50 is fixed. When the solenoid 60 is energized, the plunger 62 extends upward due to an electromagnetic force exerted on the plunger, as indicated generally by the upward pointing "energized" arrow in FIG. 6. When the solenoid 60 is de-energized, the electromagnetic force is removed and the plunger 62 retracts downward under the bias of a spring (not shown), as indicated generally by the downward pointing "de-energized" arrow in FIG. 6.

The plunger 62 carries with it to the raised and lowered positions both the bracket 64 and the sealing bar 50. To facilitate this raising and lowering, and to maintain proper alignment of the sealing bar 50, the lift mechanism 70 can include a mechanical slide lift rail 140. As shown in FIG. 6, this slide lift rail 140 can include a base 142 with upward extending pins 144 positioned at opposite ends thereof. The pins 144 are received in cylindrical bushings 146 connected to the sealing bar 50. With the base 142 mounted to the housing 12 of the vacuum sealer 10, e.g., in the cooling chamber 30, the pins 144 and bushings 146 act in combination to guide the raising and lowering movement of the sealing bar 50 into and out of the cooling chamber, and to maintain proper alignment of the sealing bar and heating elements 150 with the compression bar 40.

Figure 7:
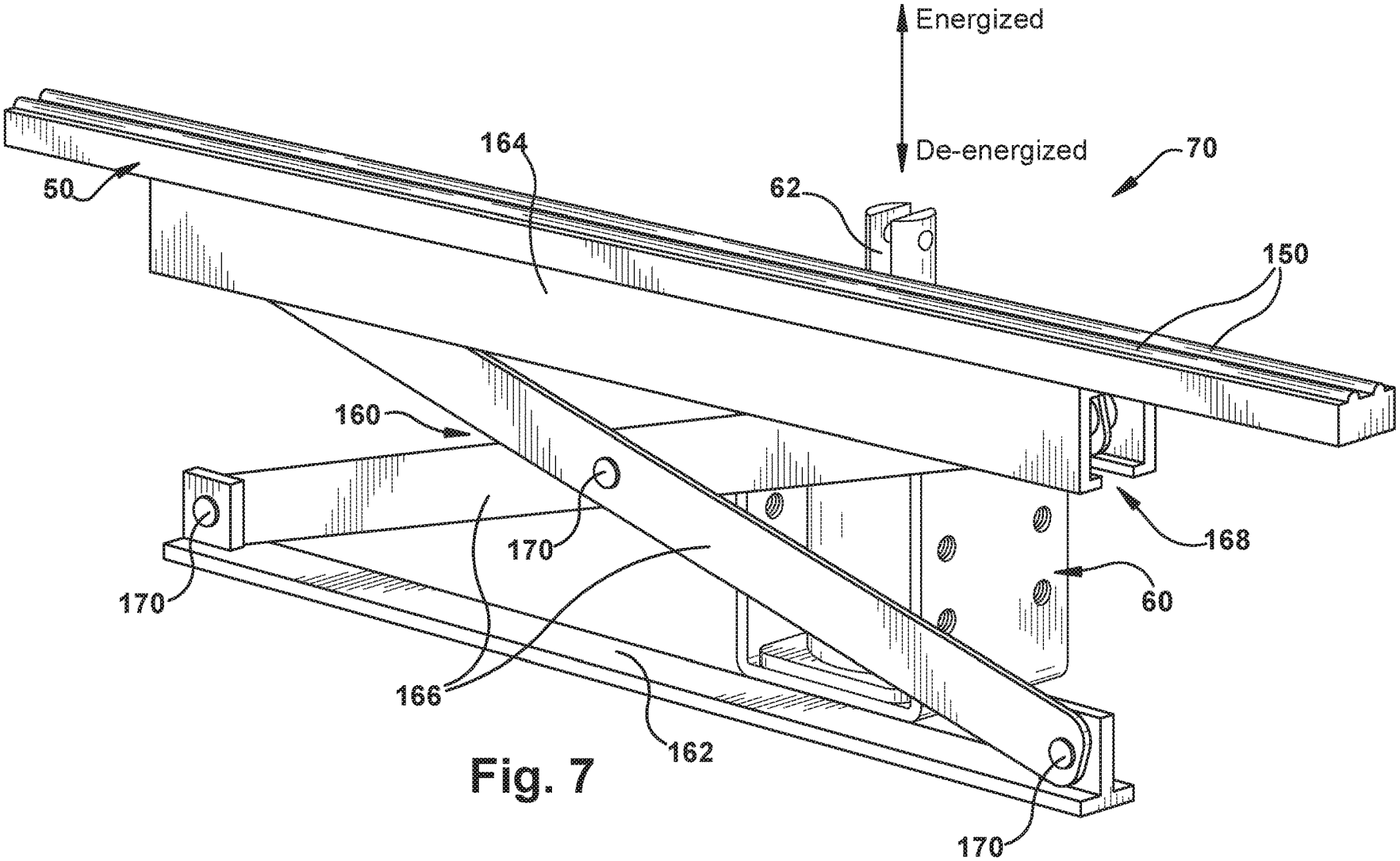
FIG. 7 is a perspective view of a scissor lift mechanism for raising and lowering the sealing bar.

FIG. 7 illustrates another example configuration of the lift mechanism 70 in greater detail. As shown in FIG. 7, like the example configuration of FIG. 6, the actuator 60 is a solenoid that includes a plunger 62. When the solenoid 60 is energized, the plunger 62 extends upward due to an electromagnetic force exerted on the plunger, as indicated generally by the upward pointing "energized" arrow in FIG. 7. When the solenoid 60 is de-energized, the electromagnetic force is removed and the plunger 62 retracts downward under the bias of a spring (not shown), as indicated generally by the downward pointing "de-energized" arrow in FIG. 7.

In the example configuration of FIG. 7, to facilitate raising and lowering the sealing bar 50 and to maintain proper alignment of the sealing bar 50, the lift mechanism 70 can include a scissor lift mechanism 160. As shown in FIG. 7, this scissor lift mechanism can include a base 162, a channeled top plate 164, and a pair of scissor arms 166. The sealing bar 50 is connected to the top plate 164 of the scissor lift mechanism 160.

A lower end of one of the scissor arms 166 has a pivoting connection 170 (e.g., a pin) to one end of the base 162, and the other of the scissor arms 166 has a lower end with a pivoting connection 170 (e.g., a pin) to an opposite end of the base 162. The scissor arms 166 are connected to each other at another pivoting connection 170 (e.g., a pin) at or about respective midpoints of the scissor arms.

The upper ends of the scissor arms 166 are received in a channel 168 of the top plate 164 and retained therein, e.g., via a pin or roller, that allows the upper ends of the scissor arms to move freely within the channel. The scissor arms 166 therefore assume a generally X-shaped configuration, as shown in FIG. 7.

The plunger 62 of the solenoid 60 is operatively connected to the top plate 164 by an element (not shown) such as a bracket. The plunger 62 thus carries with it to the raised and lowered positions both the top plate 164 and the sealing bar 50. The scissor mechanism 160 maintains the position of the sealing bar throughout its raising and lowering. As the top plate 164 is raised/lowered, the upper ends of the scissor arms 166 slide laterally within the channel 168. At the same time, the scissor arms pivot with respect to the base 162 at their lower ends, and with respect to each other at their midpoints, due to their pivoted, e.g., pinned, connections. As a result, the top plate 164 is maintained in a parallel orientation with respect to the base 162 and is constrained to upward/downward movement generally within the same plane. In this manner, the movement of the sealing bar 50, through its connection to the scissor lift mechanism 160, is controlled. The scissor lift mechanism 160 thus guides the raising and lowering movement of the sealing bar 50 into and out of the cooling chamber 30, and to maintain proper alignment of the sealing bar and heating elements 150 with the compression bar 40.

Operation

The operator begins by opening the lid 14 of the vacuum sealer 10, placing a vacuum bag 120 in the vacuum chamber 20 and aligning the open end/edge of the vacuum bag with the alignment posts 100. The operator then closes the lid 14, which initially traps the vacuum bag 120 with the compression bar 40. Next, the lift mechanism 70 is actuated, which raises the sealing bar 50 and compresses the vacuum bag 120 between the sealing bar 50 and the compression bar 40 to further trap the bag in the vacuum sealer.

The vacuum pump 130 is then operated to begin evacuating air from the vacuum chamber 20 and the vacuum bag 120. During this evacuation operation, the illumination source (LED) 110 illuminates the vacuum chamber 20, which allows for a visual confirmation that the vacuuming process is proceeding correctly. When the vacuum operation is nearly complete, the heating coils 150 are activated, which heats the sealing bar 50 to a temperature sufficient to seal the vacuum bag 120.

Following the sealing operation, the lift mechanism 70 lowers the sealing bar 50 into the cooling chamber. The cooling fan 90 then circulates convection cooling air 80 over the sealing bar 50 to cool the sealing bar prior to performing the next vacuum sealing operation.

| Reference Numbers |
|---|
| 10 Vacuum Sealer |
| 12 Housing |
| 14 Lid |
| 16 Window |
| 20 Vacuum Chamber |
| 30 Cooling Chamber |
| 40 Compression Bar |
| 50 Sealing Bar |
| 60 Solenoid |
| 62 Plunger |
| 64 Bracket |
| 70 Lift Mechanism |
| 80 Convection Cooling Air |
| 90 Fan |
| 110 Illumination Source |
| 120 Plastic Bag |
| 130 Vacuum Pump |
| 140 Slide Rail Lift |
| 142 Base |
| 144 Top Plate |
| 146 Pin |

-continued

| Reference Numbers |
|---|
| 148 Bushing |
| 150 Heating coils |
| 160 Scissor Lift |
| 162 Base |
| 164 Top Plate |
| 166 Scissor Arms |
| 168 Channel |
| 170 Pivoting Connection |

We claim:

1. A vacuum sealer for vacuum packaging a product in a plastic vacuum bag, comprising:

a vacuum chamber comprising a vacuum pump;

a cooling chamber comprising a cooling fan;

a compression bar positioned above the cooling chamber;

a sealing bar comprising a heating element, the heating element being configured, when energized, to heat the sealing bar;

a lift mechanism actuatable to move the sealing bar to a lowered position in the cooling chamber and a raised position engaging the compression bar above the cooling chamber, a lid having an opened condition and a closed condition, the lid when in the opened condition exposing the vacuum chamber and allowing for placement and removal of the vacuum bag therein, the lid when in the closed condition securing the vacuum bag in the vacuum sealer with an open end of the vacuum bag positioned in the vacuum chamber;

wherein the vacuum pump is configured to draw a vacuum in the vacuum bag, wherein the lift mechanism is configured to lift the sealing bar to the raised position above the cooling chamber, the sealing bar when in the raised position being configured to both compress a portion the vacuum bag against the compression bar and seal closed the vacuum chamber, wherein the sealing bar is configured to heat and seal closed the portion of the vacuum bag compressed against the compression bar, thus sealing closed the vacuum bag with the vacuum formed therein, wherein the lift mechanism is configured to lower the sealing bar to the lowered position in the cooling chamber, and wherein the cooling fan is configured to circulate convection air over the sealing bar to cool the sealing bar when in the lowered position in the cooling chamber.

2. The vacuum sealer of claim 1, further comprising alignment posts, positioned in the vacuum chamber, for aligning the vacuum bag in the vacuum chamber.

3. The vacuum sealer of claim 1, wherein the lid comprises a translucent window for viewing the vacuum chamber and the vacuum bag disposed therein when the lid is in the closed condition and an illumination source that is actuatable to illuminate the vacuum chamber throughout a vacuum formation and sealing process performed by the vacuum sealer.

4. The vacuum sealer of claim 1, wherein the lift mechanism comprises a solenoid for moving the sealing bar to the raised and lowered positions, and is configured to guide movement of the sealing bar between the raised and lowered positions into and out of the cooling chamber and to maintain proper alignment of the sealing bar with the compression bar.

5. The vacuum sealer of claim 4, wherein the lift mechanism comprises a base supported in the cooling chamber and a top plate that supports the sealing bar, wherein the base and top plate are interconnected by a sliding engagement that enforces relative movement of the top plate relative to the base between the raised and lowered positions in response to actuation of the lift mechanism.

6. The vacuum sealer of claim 5, wherein the lift mechanism comprises a mechanical slide mechanism comprising a base mounted pin and a top plate mounted bushing that receives the pin, wherein the sliding engagement interconnecting the base and top plate comprises a sliding engagement between the pin and bushing.

7. The vacuum sealer of claim 5, wherein the lift mechanism comprises a scissor lift mechanism comprising a pair of scissor arms arranged in an X-shaped configuration and having lower ends pivotally connected to opposite ends of the base, centers pivotally connected to each other, and upper ends slidably received in a channel of the top plate, wherein the sliding engagement interconnecting the base and top plate comprises a sliding engagement of the upper ends of the scissor arms in the channel.

8. The vacuum sealer of claim 1, wherein the vacuum pump is configured to overcome the compression exerted on the vacuum bag between the sealing bar and the compression bar so that the vacuum pump evacuates air from the vacuum bag and a vacuum is drawn in the vacuum bag.

* * * * *